United States Patent [19]

Tata

[11] 4,334,677

[45] Jun. 15, 1982

[54] TRACK TRAINER

[76] Inventor: Robert Tata, 4536 Gleneagle Dr., Virginia Beach, Va. 23462

[21] Appl. No.: 188,729

[22] Filed: Sep. 19, 1980

[51] Int. Cl.[3] ..... A63B 69/00

[52] U.S. Cl. ..... 272/100; 272/70; 280/400

[58] Field of Search ..... 272/100, 93, 70, 70.3; 119/29; 280/47.37 R, 47.37 C, 414 B, 656, 47.24, 63, 400; 298/11; 414/546, 547

[56] References Cited

U.S. PATENT DOCUMENTS

| | | | |
|---|---|---|---|
| 1,332,461 | 3/1920 | Bowden | 272/70 |
| 2,603,501 | 7/1952 | Graves | 280/414 B |
| 3,529,819 | 9/1970 | Blank | 272/70 |
| 3,985,082 | 10/1976 | Barac | 272/70 |
| 4,266,508 | 5/1981 | McNulty | 119/29 |

FOREIGN PATENT DOCUMENTS

| | | | |
|---|---|---|---|
| 222226 | 4/1969 | U.S.S.R. | 272/100 |

*Primary Examiner*—Richard J. Johnson
*Attorney, Agent, or Firm*—A. W. Breiner

[57] ABSTRACT

A training device which is particularly adapted to be drawn behind a vehicle and wherein the speed of movement of the training device may be varied is described. The training device is particularly adaptive for training people in running exercises and is constructed to take a varied portion of the weight of the person who is training while permitting the arms and legs to function in a normal manner as required by the training exercise. The device is also provided with an arm exercise device which can be utilized during the running exercise and thereby strengthening one's shoulders and arms. The device is usable for all types of training exercises including rehabilitation, and is adjustable to individuals of different height.

12 Claims, 4 Drawing Figures

FIG. 3
FIG. 1
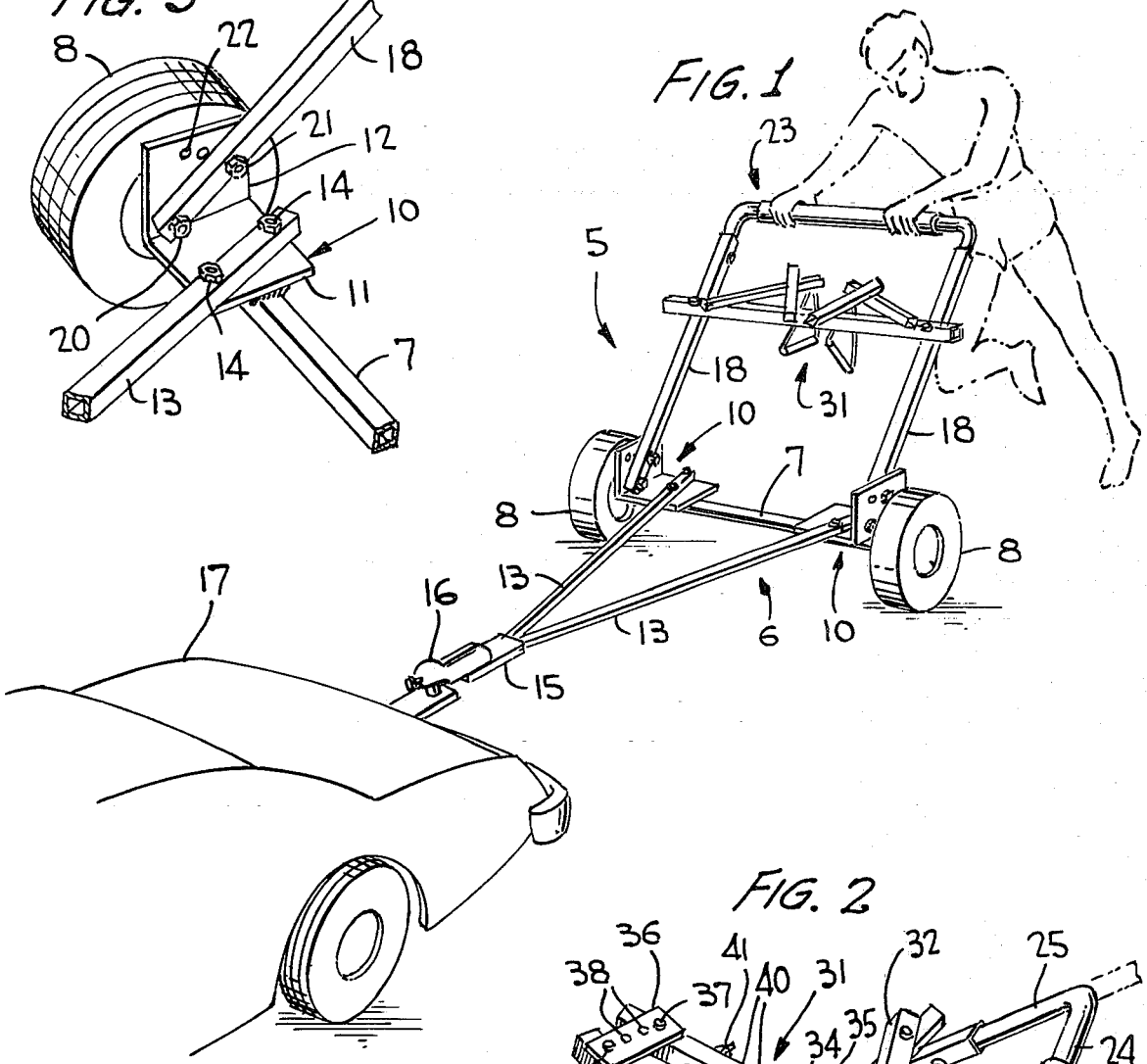
FIG. 2
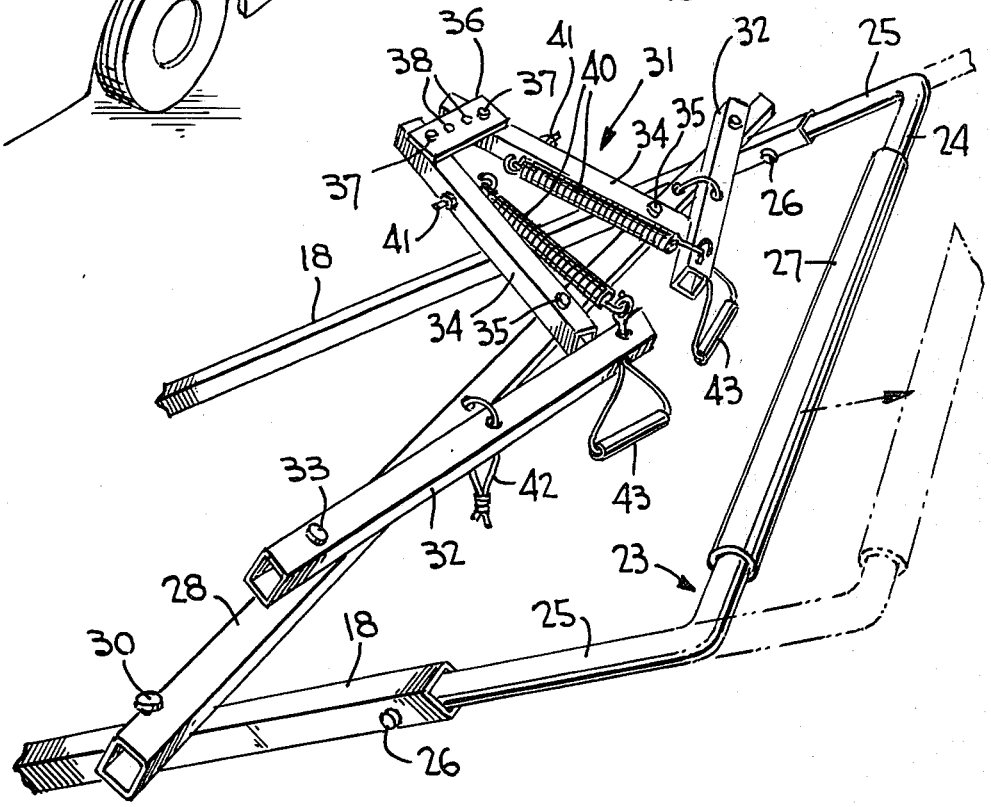

TRACK TRAINER

This invention relates in general to new and useful improvements in exercise devices, and more particularly to an exercise device which is particularly adaptive to be used in conjunction with running and leg building exercises.

The invention particularly relates to a training device which is intended to be drawn behind a vehicle wherein the device may be moved at a pre-selected rate.

One of the features of the invention is that the device can be used as an even pacer in doing middle- and long-distance training; or it can be used for speed work by mechanically pulling an individual faster than he can currently run, thereby improving speed and endurance.

One of the particular advantages of the invention is that it has a support bar which is gripped by the user, with the support bar being adjustable to be at a height wherein it aids in supporting the user by taking part of the load off of the user's legs, rendering the invention particularly useful in rehabilitating an injured leg or ankle.

Another feature of the invention is that the training device may be readily adjusted in height for different individuals and for different purposes.

Yet another feature of the invention is that the training device is provided with hand grip members which can be utilized in exercising one's arms and developing shoulder muscles while running.

The training device is not limited to athletes, but can be used in rehabilitating heart patients, patients with leg injuries, and to develop running coordination in special education students and mental patients.

Having described the invention in general terms, specific and presently preferred embodiments will be set forth in the context of the illustrative drawing.

FIG. 1 is a front perspective view of the training device and shows the same attached to a towing vehicle with a runner gripping the extender bar thereof.

FIG. 2 is a fragmentary enlarged rear perspective view showing the adjustable mounting of the extender bar and the specific details of the spring-loaded arm exercising mechanism.

FIG. 3 is an enlarged fragmentary perspective view showing the mounting of the trailer portion axle as well as the adjustable mounting of the lower end of one of the upwardly and rearwardly extending support arms.

Figure 4:
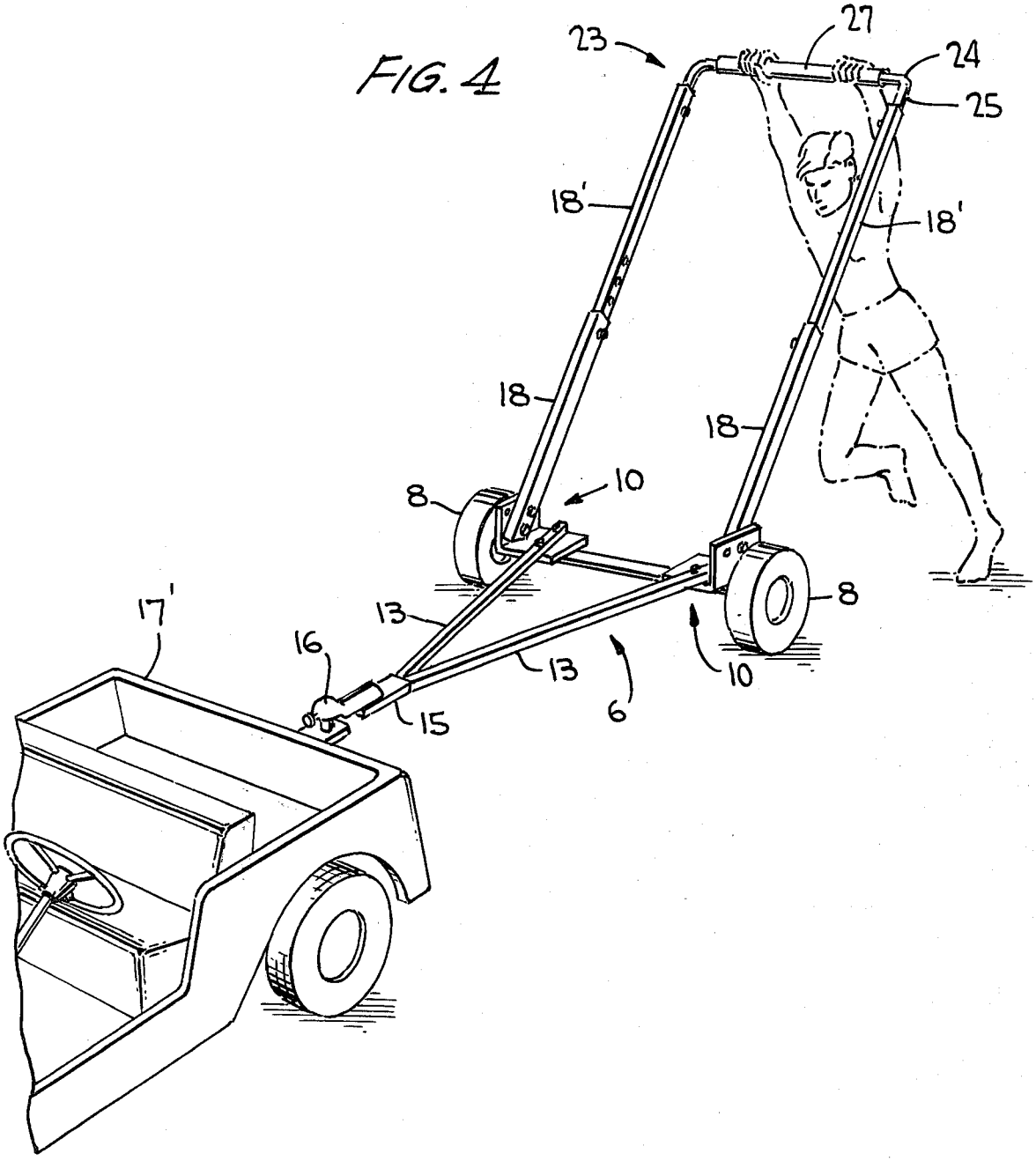
FIG. 4 is a front perspective view of the training device similar to that shown in FIG. 1 but with the arm exercise mechanism removed and with the extender bar elevated.

Referring now to the drawings, the training device generally identified by numeral 5 is fully illustrated in FIGS. 1 and 4. The training device 5 includes a trailer portion which is generally identified by the numeral 6. The trailer portion 6 includes an axle 7 having mounted on the opposite ends thereof wheels 8. Adjacent to each of the wheels 8 and as is best shown in FIG. 3, the axle 7 carries an angle bracket 10. The angle bracket 10 includes a horizontal flange 11, which is welded to the axle 7, and an upstanding flange 12, which is disposed adjacent the wheel 8.

The trailer portion 6 also includes a pair of forwardly extending frame members 13 which are fixedly secured to the angle brackets 10 by fasteners 14. The forward ends of the frame members 13 are secured to a connecting plate 15 which, in turn, carries a trailer hitch 16 for facilitating the removable securement of the trailer portion 6 to a pulling vehicle, such as a motor car 17 as shown in FIG. 1 or a golf cart 17' as shown in FIG. 4. It is to be recognized that the towing vehicle can be an electrically or gas-operated device of varying design. Since the training device is relatively light it can be towed by many vehicles.

The trailer portion 6 carries a pair of upwardly and rearwardly extending arms 18 which have their lower ends secured to the vertical flanges 12 of the angle brackets 10, as is shown in FIG. 3. Each arm 18 is secured to the angle bracket 10 by a lower bolt 20 having a fixed position, and by an upper bolt 21 which selectively passes through one of a plurality of apertures 22 in the respective flange. Thus, each arm 18 may be vertically adjusted by removing the bolt 21 and tilting the arm 18 to the desired angle, and then replacing the bolt 21 in a selected one of the apertures 22.

The arms 18 carry an extender bar, generally indentified by the numeral 23. The extender bar 23 includes a cross or stride bar portion 24 and a pair of legs 25. The arms 18 are hollow and the legs 25 are of a size to be telescoped therein. The legs are fixed to the arms 18 in an adjusted position by means of bolts 26. At this time it is pointed out that the legs 25 may be provided with a plurality of apertures for receiving the bolts 26 so that the extender bar 23 may be adjusted relative to the arms 18 and, thus, vertically adjust the position of the cross or stride bar 24. Further, the cross or stride bar 24 is preferably provided, at least in the central portion thereof, with a suitable covering 27. It will be apparent that as a modification, rather than having legs 25 which telescope into arms 18, it is possible to utilize straight extender bars 18' as shown in FIG. 4 which will fit over or, as shown, into arms 18 with the cross or stride bar 24 having only short legs 25 which telescopically fit into the opposite end of the extenders. This modified arrangement can be particularly useful when substantial height is needed as when the device is used to rehabilitate an injured ankle or leg, again as shown in FIG. 4.

As illustrated in FIGS. 1 and 2, the upper portions of the arms 18 can be connected together by a bar 28 which extends traversely between the arms 18. Opposite end portions of the bar 28 are secured to the arms 18 by means of fasteners 30. The bar 28, in turn, carries an arm exercise device, generally identified by the numeral 31.

The arm exercise device includes a first pair of bars 32 which have their forward end portions pivotally secured to the bar 28 by means of fasteners 33. The bars 32 extend rearwardly in converging relation.

A second pair of bars 34 have rear end portions thereof pivotally secured to central portions of the bar 28 by means of fasteners 35 which permit pivoting thereof. The bars 34 extend forwardly from the bar 28 and have their forward ends connected together by a link 36 which is pivotally connected to the forward end of the bars 34 by means of fasteners 37. If desired, the link 36 may be provided with an additional set of apertures 38 for receiving the fasteners 37.

Normally, the bars 34 have the rear ends thereof opposing and generally abutting rear portions of the bars 32. The bars 32 have secured to the rear end portions thereof rear ends of tension springs 40. The forward ends of the springs 40 are connected to forward portions of the bars 34 by means of fasteners 41. The springs generally hold the bars 32 in abutting relation with the rear ends of the bars 34.

The bars 32 are also secured to the bar 28 by means of straps 42 which limit the pivoting of the bars 32. Further, rear portions of the bars 32 are provided with grip members 43 which may be easily grasped by one's hand.

When it is desired to use the arm exercise device 31, the extender bar 23 is removed by removing the fasteners 26 and access to the arm exercise device is made available. The arm exercise device 31 may be utilized with the device while it is stationary or when running behind the exercise device.

As pointed out above, the cross or stride bar 24 may be readily adjusted to the proper height for the person who is training and for the type of training desired. By properly positioning the cross or stride bar 24, as illustrated in FIG. 4, that portion of the weight of the person using the device to be transferred to the device can be varied. In this way the device, as above stated, can be used to rehabilitate a person having a leg or ankle injury.

It is to be understood that the device 5 can be used to perfect individual striding and at the same time prevent injuries to the lower extremities by regulating the amount of foot thrust hitting on each stride. Also, the device 5 can be used by all athletes for warm-up and pre-training, spring training, etc. By utilizing the arm excercise device 31, the device can be used to develop shoulder and arm muscles while running.

It will be apparent that by controlling the amount of the person's weight which is to be carried by the cross or stride bar 24, as shown in FIG. 4, the device 5 can be used to mobilize persons who have severe ankle and knee problems.

Finally, the training device will provide faster runners with greater endurance with much less training energy expended in view of the fact that a large portion of the athlete's weight is carried by the training device.

Although the preferred embodiment of the claimed device has been specifically illustrated and described herein, it is to be understood that minor variations may be made in the training device without departing from the spirit and scope of the invention as defined by the appended claims.

It is claimed:

1. A track training device comprising a trailer unit including an axle, wheels, a frame having transversely remote mounting brackets and a tow hitch; and a support unit carried by said frame, said support unit including a pair of upwardly and rearwardly extending arms and including means for adjusting the length of said arms, a transverse bar carried by said arms, means for securing said arms to said mounting brackets in different upwardly sloping positions whereby the height of said bar may be selectively varied, and grip means on said bar, said transverse bar and grip means being sized and constructed to permit grasping by the hands of a human being positioned behind said trailer unit.

2. A track training device according to claim 1 wherein said grip means are an intermediate portion of said bar.

3. A track training device according to claim 1 wherein said grip means are an intermediate portion of said bar and said bar has axial end portions telescoped relative to said arms.

4. A track training device according to claim 3 wherein there are fastening means securing said axial end portions to said arm for selective extension of said axial end portions relative to said arms including complete separation of said axial end portions from said arms.

5. A track training device according to claim 4 wherein there is a second transverse bar extending between and secured to said arms, and hand exercise means carried by said second transverse bar.

6. A track training device according to claim 1 wherein said grip means are parts of a hand excercise device.

7. A track training device according to claim 6 wherein said hand exercise device includes a first pair of members pivotally connected to a central portion of said bar and extending forwardly therefrom, a link extending between and pivotally connected to forward portions of said members of said first pair, a second pair of members pivotally connected to transversely outer portions of said bar and extending rearwardly and inwardly into longitudinal overlapping relation to said first members, and tension spring elements extending between rear portions of said members of said second pair and forward portions of members of said first pair; and said grip means are carried by said members of said second set.

8. A track training device according to claim 7 wherein said grip means are secured to said members of said second set adjacent the connections of said springs thereto.

9. A track training device according to claim 7 wherein all of said members lie in a common general plane, and said members of said second set edge abut rear ends to respective members of said first set.

10. A method of training comprising the steps of (a) providing a training device comprising a trailer unit including an axle, wheels, frame, and a tow hitch; and a support unit carried by said frame, said support unit including a pair of adjustable upwardly and rearwardly extending arms and a transverse bar carried by said arms for grasping by a user positioned behind said trailer unit; (b) adjusting said transverse bar to a height which accommodates the user; and (c) towing said training device and said user at a speed adjusted to the condition of the user.

11. The method of claim 10 wherein said transverse bar is adjusted to the running height of the user and the device is towed at a speed greater than the top speed of the runner under normal conditions.

12. The method of claim 10 wherein said transverse bar is adjusted to approximately the extended reach of the user, whereby substantial weight is taken off the legs and/or ankles of the user, and the vehicle is towed at a slow speed.

* * * * *